US006637441B2

(12) United States Patent
Kennedy et al.

(10) Patent No.: US 6,637,441 B2
(45) Date of Patent: Oct. 28, 2003

(54) HAIR WRAPPER

(75) Inventors: Melvin R. Kennedy, Lantana, FL (US); José Longoria, Miami, FL (US)

(73) Assignees: Spectrum Associates LLC, Boca Raton, FL (US); Kennedy/Matsumoto Design LLC, Lantana, FL (US); Longoria Design LLC, Miami, FL (US)

( * ) Notice: Subject to any disclaimer, the term of this patent is extended or adjusted under 35 U.S.C. 154(b) by 105 days.

(21) Appl. No.: 10/047,489

(22) Filed: Jan. 14, 2002

(65) Prior Publication Data

US 2003/0131867 A2 Jul. 17, 2003

(51) Int. Cl.[7] ..... A45D 7/02; D02G 3/36

(52) U.S. Cl. ..... 132/212; 132/271; 242/422.5; 242/593; 57/10

(58) Field of Search ..... 132/212, 271, 132/273, 56; 242/442, 422.5, 593; 57/3, 4, 5, 10, 58.52, 58.83

(56) References Cited

U.S. PATENT DOCUMENTS

| | | | |
|---|---|---|---|
| 739,461 | A | 9/1903 | Warren |
| 1,048,687 | A | 12/1912 | Goodrick |
| 1,392,611 | A | 10/1921 | Adams |
| 1,927,261 | A | 9/1933 | Evans |
| 3,259,370 | A | 7/1966 | Neale, Sr. |
| 4,013,500 | A | 3/1977 | Koput et al. |
| 4,346,550 | A | 8/1982 | Ferree |
| 4,824,036 | A | 4/1989 | Buta |
| 4,856,721 | A | 8/1989 | Bonello et al. |
| 5,456,271 | A | 10/1995 | Legette |
| 5,558,105 | A | 9/1996 | Rosenwinkel et al. |
| 5,671,759 | A | 9/1997 | Chung et al. |
| 5,810,022 | A | 9/1998 | Reynolds |
| 5,967,151 | A | 10/1999 | Villani et al. |
| 5,988,181 | A | 11/1999 | Gable et al. |
| 6,109,275 | A | 8/2000 | Mendezmonsanto |

*Primary Examiner*—Kevin Shaver
*Assistant Examiner*—Stephanie Willatt
(74) *Attorney, Agent, or Firm*—Akerman Senterfitt

(57) ABSTRACT

A hair wrapping device and method which includes a housing and a motor contained within the housing. A cover is rotatably mounted to the housing and is driven by the motor. A spool for receiving cord is mounted for rotational movement with the cover. The cord is held for rotation with the cover. The cover has an aperture to thread a lock of hair and the cord therethrough. Rotation of the cover by the motor causes rotation of the cord around the lock of hair, thereby wrapping the hair with the cord.

22 Claims, 6 Drawing Sheets

HAIR WRAPPER

CROSS-REFERENCE TO RELATED APPLICATIONS

Not applicable.

STATEMENT REGARDING FEDERALLY-SPONSORED RESEARCH

Not applicable.

BACKGROUND OF THE INVENTION

1. Field of the Invention

This invention relates generally to a hair wrapper, and more particularly to a device that wraps hair with a cord.

2. Background of the Invention

Many forms of hair braiding, beading and other hair decorations are known. One of the known forms of hair decoration is hair wrapping, where a lock of hair is wrapped with a decorative cord. Hair wrapping is usually performed manually, which can be a long and laborious process. Several attempts have been made to automate the hair wrapping process, including a device disclosed in U.S. Pat. No. 4,824,036 to Buta. The Buta patent describes an apparatus containing a cental tube in which hair is placed. The tube is surrounded by a revolving disk on which a spool and thread guide are mounted.

Rotation of the disk by a motor causes the thread guide to circle around the hair, wrapping the hair with thread. A toy hair wrapping device is disclosed in U.S. Pat. No. 5,671,759 to Chung et al. which utilizes a hollow spindle for receiving a lock of hair. The spindle is rotatable by a motor. The spindle has detents for receiving and holding a cord such that rotation of the spindle causes wrapping of the cord around the hair.

The known devices are complicated to manufacture, and perform the hair wrapping in the internal portions of the devices, where it is difficult for the user to see the process. With known hair wrapping devices, there is difficulty in correcting mistakes. Additionally, if hair tangling occurs or if a cord is wrapped at a tension that is too high, it is possible for the known devices to cause injury.

SUMMARY OF THE INVENTION

One aspect of the invention relates to a hair wrapping device, which includes a housing and a motor contained within the housing. A cover is rotatably mounted to the housing and is driven by the motor. A spool for receiving cord is mounted for rotational movement with the cover. The cord is held for rotation with the cover. The cover has an aperture to thread a lock of hair and the cord therethrough. Rotation of the cover by the motor causes rotation of the cord around the lock of hair, thereby wrapping the hair with the cord. By holding the cord for rotation with a cover, the wrapping process can take place at the top of the cover, thus making the wrapping process easily visible to the user, ensuring that mistakes and tangles may be noticed quickly before they become too difficult to undo or before they pull the hair.

In one embodiment, the motor can be a reversible motor, and mistakes in the wrapping process can be corrected by reversing the direction of wrapping. In another embodiment, the aperture in the cover has an area disposed off-center for receiving the lock of hair, the aperture narrowing towards the center for securely holding the lock of hair in the center of the cover and spool. The enlarged off-center area of the central aperture allows the hair to be easily threaded through the aperture, while the narrower central area of the aperture allows the hair to be held in a compact bundle for wrapping.

In a further embodiment, a tensioner which holds the spool against rotation at a predetermined tension is also included. Rotation of the cover by the motor causes rotation of the cord around the lock of hair, thereby wrapping the hair with the cord at the predetermined tension. Yet a further embodiment of the invention includes a manually operated mechanism for manually rotating the spool for adjustment of the cord wrapped around the hair.

Another aspect of the invention relates to a method of wrapping hair with cord. The method includes providing a hair wrapping device having a housing, a motor contained within the housing, a cover rotatably mounted to the housing and driven by the motor. The cover has an aperture therethrough, and a spool mounted to the cover for rotational movement. The method also includes wrapping cord around the spool. The cord is held for rotation with the cover. A lock of hair and the cord are threaded through the aperture in said cover. The motor is operated to rotate said cover, thereby wrapping the hair with said cord.

Wrapping the hair can take place on top of the cover, whereby the user can view the wrapping process. The hair wrapping device can include a reversible motor, and the method can further include at least partially reversing the wrapping by means of the reversible motor. The hair wrapping device can include a manual adjustment mechanism, and the method can further include manually adjusting the wrapping by means of the manual adjustment mechanism. The spool can be held against rotation at a predetermined tension, to impart tension to the cord.

The aperture in the cover can have an area disposed off-center, and the aperture can narrow towards the center of the cover. Threading the lock of hair and the cord can include threading the hair and the cord into the off-center area of the aperture, and moving the hair and the cord into the narrowing of the aperture, whereby the lock of hair can be securely held in the center of the cover. Threading the lock of hair and the cord through the aperture in the cover can include the use of a threader.

BRIEF DESCRIPTION OF THE DRAWINGS

There are shown in the drawings embodiments which are presently preferred, it being understood, however, that the invention is not limited to the precise arrangements and instrumentalities shown, wherein.

DETAILED DESCRIPTION OF A PREFERRED EMBODIMENT

Figure 1:
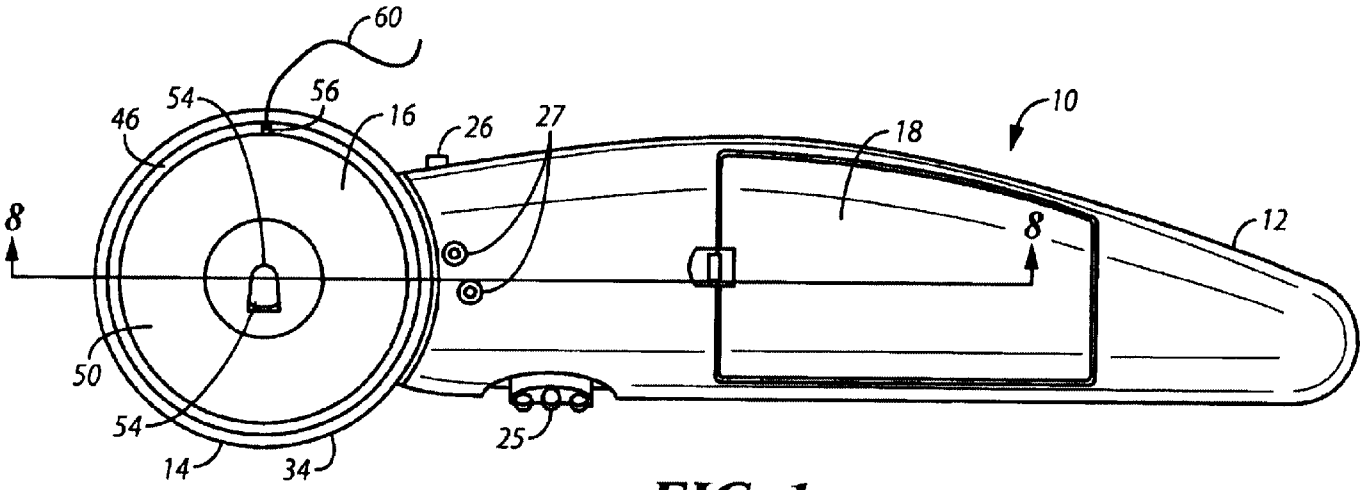
FIG. 1 is a top view of a hair wrapper according to the present invention.
Figure 2:
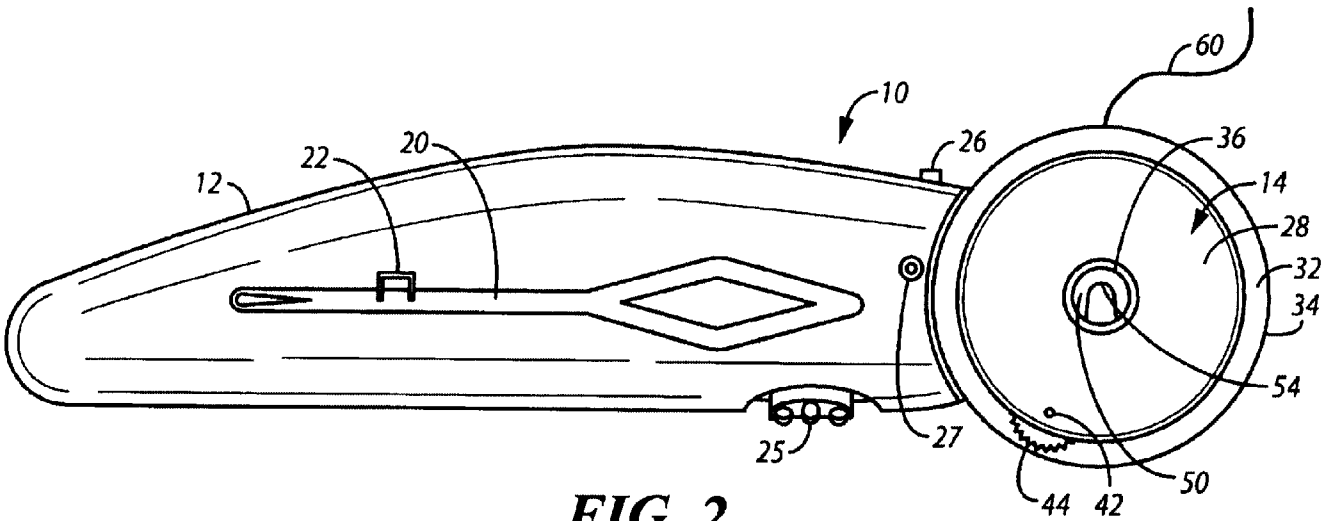
FIG. 2 is a bottom view of a hair wrapper according to the invention.

Referring to FIGS. 1–4, a hair wrapper 10 according to the invention is designed for wrapping a lock of hair with a cord. The hair wrapper 10 can include a housing 12 having a holder 14. A cover 16 can be mounted to the holder. The holder 14 and cover 16 may both be any suitable shape, such as circular, and the cover 16 may be rotatable within the holder 14. Both the holder 14 and the cover 16 can have central apertures through which hair to be wrapped can be threaded. The housing 12 can be molded of any suitable material, such as plastic or metal, and it will be appreciated that any suitable shape and design of housing 12, holder 14 and cover 16 may be employed. A cord may be constrained for rotation with the cover 16 so that rotation of the cover causes the hair to be wrapped with the cord.

The housing 12 can be ergonomically shaped to provide a comfortable handle for the hair wrapper 10 and can have a battery hatch 18, a groove 20 for receiving a threader 21 and a latch 22 for retaining the threader 21 in the groove 20. The threader 21 enables hair to be easily threaded through the wrapper 10 and can include a loop portion 23, which can be flexible, and a handle 24. The groove 20 and threader 21 may be of any suitable form. A button 25, which may be slidably operational, and a latch 26 may also be included on housing 12. Any suitable form of operating button or mechanism may be provided. The latch 26 can help retain the cover 16 in the holder 14 and can be biased into position by a spring (not shown). In some arrangements, a latch 26 may not be necessary, and where provided, may be of any suitable form. The housing 12 can be made in two parts for ease of manufacture, and can be held together with one or more fasteners 27, such as screws.

Figure 3:
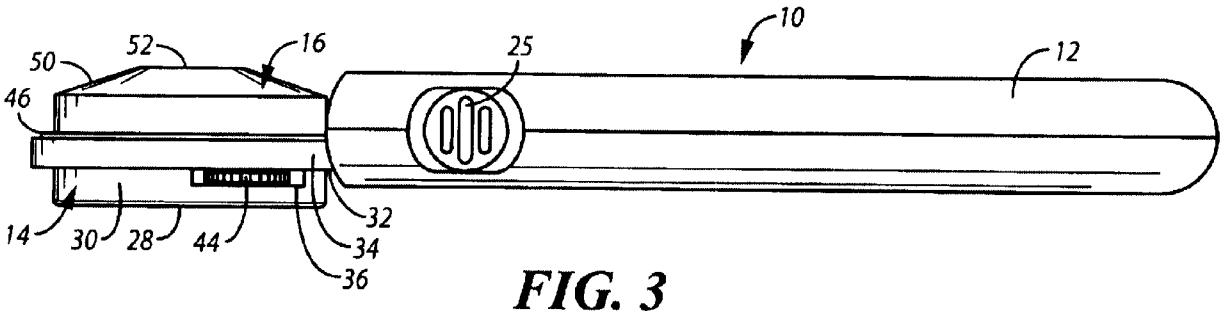
FIG. 3 is a side view of the a wrapper according to the invention.
Figure 4:
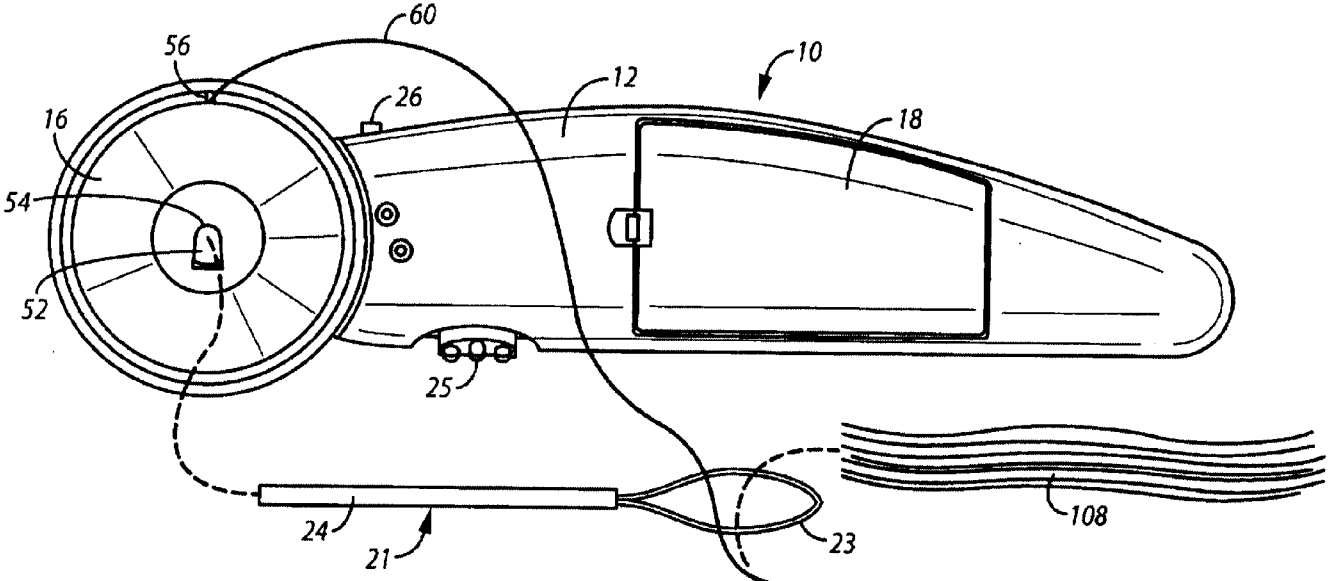
FIG. 4 is a top view of a hair wrapper and threader.
Figure 5B:
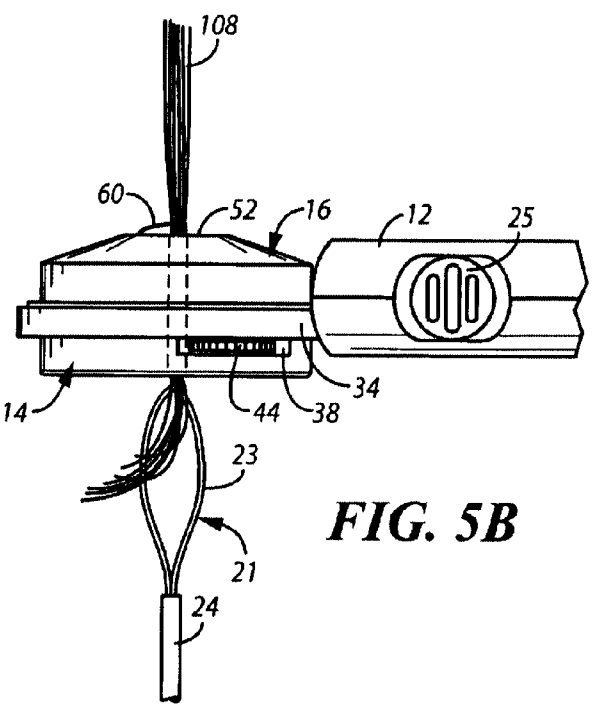
FIG. 5*b* shows a threader pulling hair and cord through a hair wrapper according to the invention.
Figure 5C:
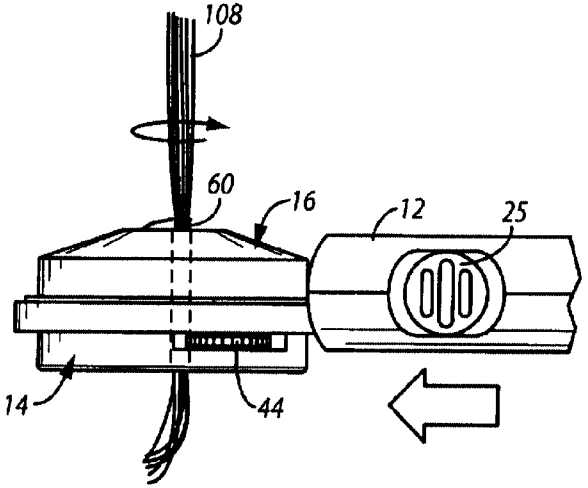
FIG. 5*c* shows a hair wrapper according to the invention in use.
Figure 5A:
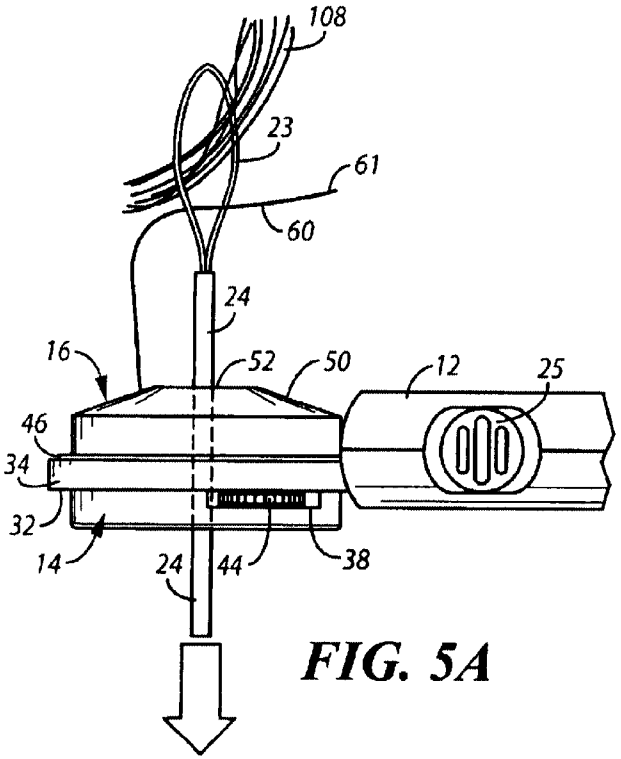
FIG. 5*a* shows a threader being passed through a hair wrapper according to the invention.
Figure 8:
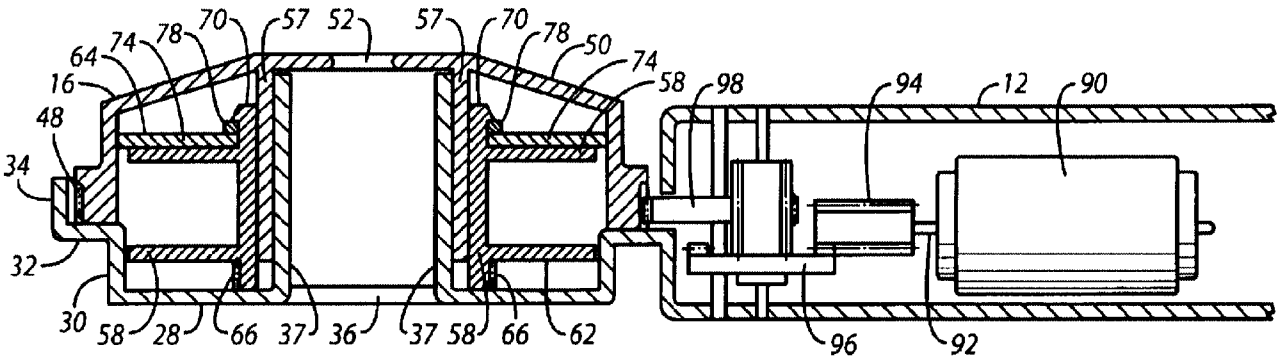
FIG. 8 is a partial sectional view through lines 8—8 of FIG. 1.
Figure 11:
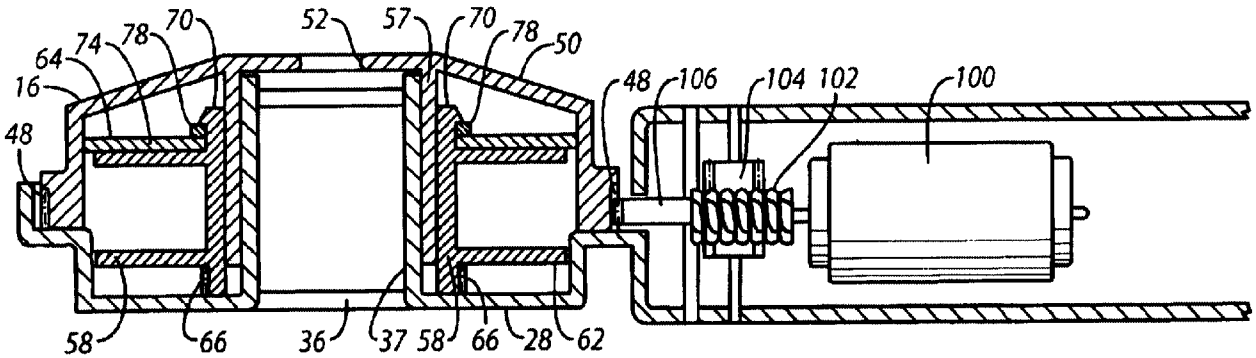
FIG. 11 shows a partial sectional view of an alternative embodiment of a hair wrapper according to the invention.

Referring to FIG. 3, the holder 14 can have a base 28 from which a wall 30 extends. The wall 30 can lead to an outwardly extending shoulder 32 and an outer lip 34. A substantially central base aperture 36 can extend through the base 28, with a sleeve 37 (shown in FIGS. 8 and 11) extending upwardly around the aperture 36. A sideways extending slot 38, (shown in FIGS. 5A and 5B), can be located in the wall 30. An opening can be provided adjacent slot 38, into which a supporting pin 42 can be located for a thumb gear 44 which allows for manual alteration of the hair wrapping. The thumb gear 44 can protrude partially out of slot 38, and in the illustrated embodiment does not extend beyond lip 34. In some arrangements, the thumb gear 44 does not need to be included in the hair wrapper 10, particularly if manual alteration of the wrapping process is not desired.

The cover 16 can include at its base a wall 46 that has the same diameter as or a slightly reduced diameter than wall 30 of the holder 14. At the base of the wall 46 there may be an outer gear 48 (shown in FIGS. 6 and 7) that is locatable within the lip 34 of the holder 14. In the illustrated arrangement, cover 16 has a top 50 of frusto-conical shape, with a substantially central cover aperture 52, although it will be appreciated that any suitable design of cover 16 may be used. Cover aperture 52 can be of a generally triangular or any other suitable shape. The cover aperture 52 can have a rounded apex 54 located at the center of top 50, and the remainder of the triangle can be disposed off-center. The apex 54 can have a radius approximately equal to that of the lock of hair that is to be wrapped. The cover aperture 52 can have an off-center area through which hair may be inserted or threaded, and can have a smaller area, preferably located in a substantially central portion of the cover 16, in which the hair may be tightly held during the wrapping operation. Any suitable shape of aperture 52 may be used. For example, the aperture may have a triangular, tapered, keyhole, diamond or fusiform shape, amongst others. A slot 56 can be located in wall 46 opposite to apex 54 of the aperture 52. A sleeve 57 (shown in FIGS. 8 and 11) can extend downwardly from top 50, around aperture 52.

Figure 10:
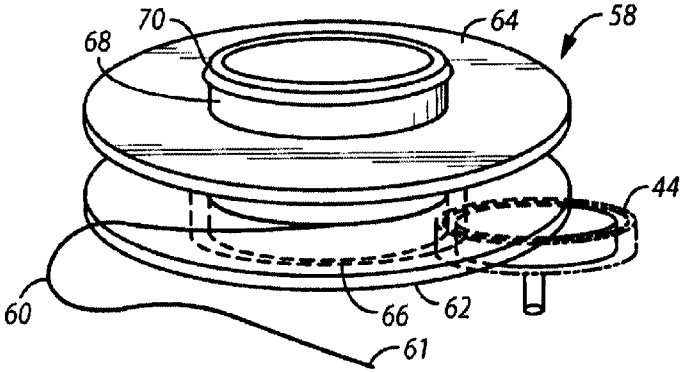
FIG. 10 is a perspective view of a spool and thumb gear for use with a hair wrapper according to the invention.

A spool 58 (shown in FIGS. 8 and 11), can be provided on which a cord 60 having a free end 61 can be wrapped. The cord 60 may be any type of cord, and may be of any suitable material, such as cotton, silk, synthetic material, and wool. In one preferred arrangement, the cord 60 does not stretch in use, although an elastic cord can be used if a looser winding of the cord 60 is desired for a spiral wrapping effect. The cord 60 may be of any suitable thickness, and need not have a circular cross-section. For example, the cord 60 can be a ribbon. Referring to FIG. 10, the spool 58 can have a bottom surface 62 and an upper surface 64. A spool gear 66 can protrude from the bottom surface 62. The spool 58 can have a central tube 68 having a bore 69, the central tube 68 extending above upper surface 64. An outwardly projecting chamfered lip 70 can be provided around the top of the tube 68.

Figure 9:
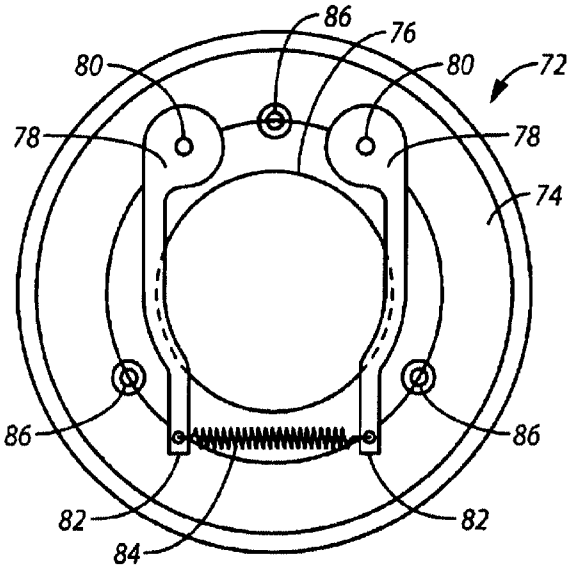
FIG. 9 is shows a tensioner located in a cover for a hair wrapper according to the invention.

The cover 16 can include a tensioner 72, illustrated in FIG. 9, that can be formed of a tensioner plate 74 having a substantially central tensioner aperture 76. Legs 78 can be connected to the tensioner plate 74 at ends 80. Opposite ends 82 of the legs 78 can be joined by a transverse spring 84. The legs 78 can overlap the edge of aperture 76 slightly. The tensioner plate 74 can be secured within the cover 16 in any suitable manner, such as by pins or screws (not shown) passing through a plurality of apertures 86, so that the tensioner mechanism may be protected inside the cover 16. The tensioner can hold the spool 58 against rotation at a fixed tension, and it will be appreciated that any suitable tensioning device may be used in the hair wrapper 10. In some arrangements, the tensioner 72 does not need to be included in the hair wrapper 10.

Figure 6:
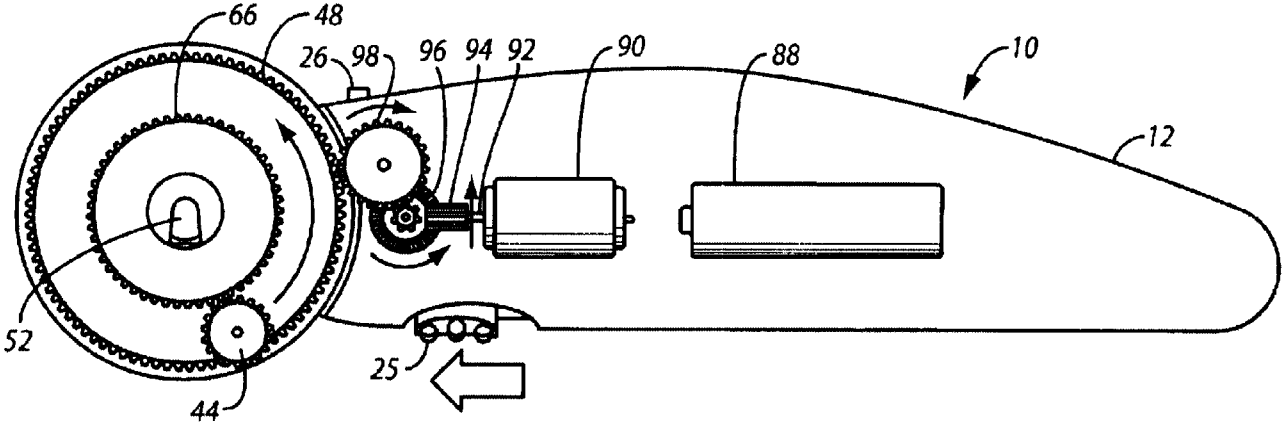
FIG. 6 is a schematic view of a hair wrapper showing one embodiment of a gear assembly with gears turning in a first direction.
Figure 7:
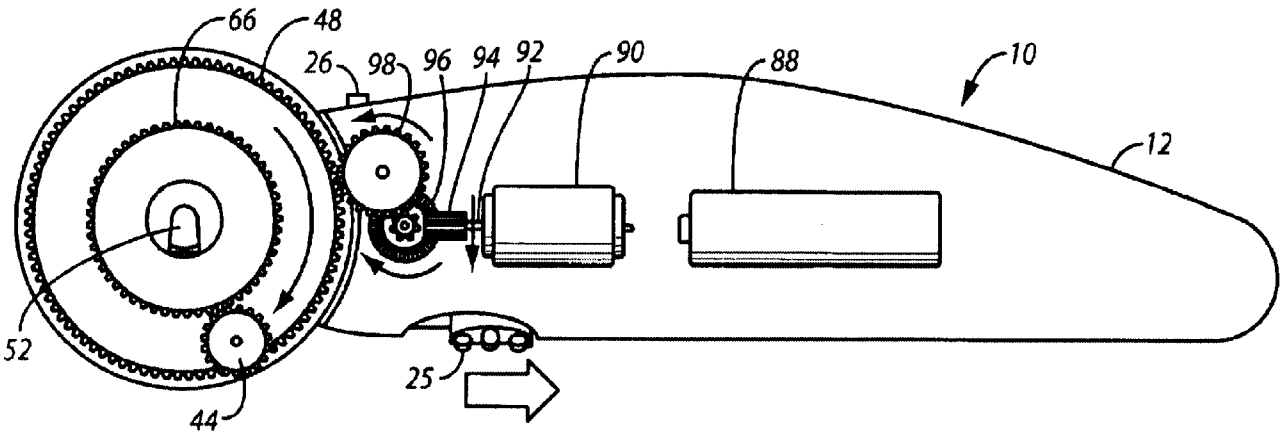
FIG. 7 is a schematic view of the hair wrapper of FIG. 6 with the gears turning in a second direction.

A battery 88 and a motor 90 can be housed within the housing 12, as shown in FIG. 7. The motor 90 can be any suitable motor, including a reversible motor and can be operatively connected to the button 25. In one arrangement, movement of the button 25 in a forwards direction, as shown in FIG. 6, may operate the motor in a forwards direction, and movement of the button 25 in a reverse direction, as shown in FIG. 7, may operate the motor in a reverse direction. As shown in FIG. 6, the motor 90 can drive a shaft 92, to which a first gear 94 can be connected. The first gear 94 can drive a second gear 96, which in turn can drive a third gear 98, which may be an idler gear. In an alternative arrangement shown in FIG. 11, a motor 100 can drive a worm gear 102, which in turn can drive gears 104, 106. It will be appreciated that any suitable form of motor, gear arrangement and power source may be employed. For example, the motor may be powered by a power lead or by battery, such as by one or more AA batteries. The motor may be any type of motor, and if a non-reversible motor is used, it may employ further gears and/or clutches in order to reverse direction if desired. The gearing may be selected to achieve an optimum gear ratio for a desired speed of operation and a desired power source. For example, a higher gear ratio may be employed so that the hair wrapper may be driven at a desired speed but powered by a smaller power source such as fewer or less powerful batteries. It will be understood that the size and method of operation of the battery and/or motor is not limited to the examples provided herein, and that any suitable power source, battery, motor or electrical generator may be used. In addition, in some arrangements, it may be desirable to power the hair wrapper manually.

To assemble the hair wrapper 10, the spool 58 can be threaded with the cord 60, and the spool 58 can be offered into the cover 16 over the sleeve 57. The lip 70 of the spool 58 can be inserted into the aperture 76 of the tensioner 72. The chamfer of the lip 70 can cause the legs 78 of the tensioner 72 to be pushed outwardly against the force of the spring 84. As can be seen most clearly in FIG. 8, the legs 78 can retract together after the lip 70 of the spool 58 has been fully inserted into the tensioner 72. The legs 78 can rest underneath the lip 70 and can grip the central tube 68 of the spool 58. The spool 58 can thus be restrained against rotation at a fixed tension by the frictional force of the legs 78. The free end 61 of the cord 60 can be drawn through the slot 56 to rest on the top 50 of the cover 16. The spool 58 can be free to rotate on the sleeve 57 to enable the cord to be easily unwound.

The latch 26 of the housing 12 can be retracted, and the cover 16 placed into the lip 34 of the holder 14. The gear 48 of the cover 16 can locate within the lip 34, and can align with the third gear 98. Sleeve 57 of the cover 16 is inserted over sleeve 37 of the base 14. The thumb gear 44 can also be aligned with the spool gear 66. The latch 26 can then be released to secure the cover 16 in place.

In operation, and referring to FIGS. 4–8, the threader 21 can be removed from groove 20, and grasped by the user. The user can thread a lock of hair 108 through the loop portion 23 of the threader 21. The cord 60 can also be threaded through the loop portion 23. The free end of the handle 24 can be inserted into the cover aperture 52 of cover 16 (FIG. 5A), and can also pass through the bore 69 of the spool 58 and out of the base aperture 36 of the holder 14. The threader 21 can be drawn fully through the apertures of the hair wrapper (FIG. 5B), thus drawing the hair 108 and cord 60 through the cover 16, spool 58 and holder 14. It will be appreciated that the hair and cord may be threaded through the apertures of the hair wrapper without the use of a threader, and that if a threader is used, it may be of any suitable form. The wider area of the cover aperture 52 of the cover 16 can aid with the threading the hair into the hair wrapper 10.

The hair wrapper 10 can be moved up the hair until it is as close as possible to the hair root. The cord 60 can be pulled so that the spool 58 is unwound manually until the free end 61 of the cord 60 extends to a length slightly longer than the length of the hair 108 to be wrapped. The hair wrapper 10 can be moved to the end of the hair instead of being moved to the root of the hair if the user desires to wrap the hair from the end rather than the root. Further, it is not necessary to wrap the complete length of hair, as only a section of the hair may be wrapped to achieve a desired effect.

In one example, the user can slide the button 25 forwards, which can cause a motor 88 to operate the gears 94, 96 and 98 in a forwards direction, as shown in the example of FIG. 6. In this example, the gear 98 interacts with the gear 48 to rotate the cover 16. As the cord 60 is restrained by the slot 56, the cord is rotated around the hair 108 with rotation of the cover 16, and pulls the cord 60 from the spool 58, thus rotating the spool 58 about the sleeve 57. It does not matter if the cord 60 has been wound clockwise or counterclockwise onto spool 58, as the spool 58 may rotate in either direction, independently of the direction of rotation of the cover 16. The tensioner 72 can ensure that a consistent tension is maintained in the cord 60 during the rotation of spool 58. Due to the shape of the aperture 52 in cover 16, and because the slot 56 is opposite to the apex 54 of the aperture, the tension in the cord 60 pulls the lock of hair into the apex 54 as the hair is wrapped. As a result, the lock of hair 108 can be retained in a tight bundle having approximately the radius of the rounded apex 54.

During the rotation of cover 16, and hence wrapping of the cord 60 around the hair, the hair wrapper 10 can be moved slowly down or up the lock of hair 108 so that the desired length of the lock of hair is wrapped with cord. The hair wrapping can take place on top of, or close to, the top of cover 16, in the region of the cover aperture 52. The wrapping process can thus be in view of the user. If the user feels that they have made a mistake in the wrapping, for example, if they have moved the hair wrapper down the lock of hair too quickly and obtained a wrapping which is too sparse, they can easily see the results of the mistake. As shown in FIG. 7, moving the button 25 in a reverse direction (to the right as shown in the drawing) can cause the motor 90 to reverse direction. As a result, the cord 60 can be wound back onto the spool 58, allowing the user to unwrap the cord 60 from the hair. Once the area of wrapping in which the mistake occurred has been undone, the user can slide the button 25 to the left again to continue wrapping. It will be appreciated that if the user has wrapped the cord 60 on the spool 58 so that reverse wrapping is required, moving the button 25 forwards (to the left as shown in FIG. 6) can cause the motor 90 to reverse direction and unwrap the hair.

The user may also or in addition operate thumb gear 44 to manually rotate spool 58 by means of the gear 66 when the button 25 is in an "off" position, which can be a centrally located position. The thumb gear 44 may be used to finely adjust the wrapping by retracting the cord 60 to take up any slack in the cord 60. For example, after reversing the wrapping to remove a mistake, the user may tighten the cord 60 to the correct tension using thumb gear 44 before continuing to wrap in the forwards direction. If it is desired to clip beads or other decorations onto the cord at intervals during the wrapping process, the wrapping may be stopped and loosened slightly using the thumb gear 44 to enable a short length of the cord 60 to be freed for the purposes of attaching a decoration. After the thumb gear 44 has been used as desired, the user can continue the wrapping using motor 90 as before.

When the wrapping is complete, the user can cut the cord 60, and may tie the cut end of the cord with the free end 61 that was left slightly longer than the hair to be wrapped. The hair wrapping may be completed with any suitable beads, ties or other ornaments. Advantageously, the cord can be multicolored, that is, it can have sections of different colors so that a striped effect is given to the wrapping, although any colors or effects may be employed. The cover 16 may then be removed from the holder 14 using the latch 26 so that the spool 58 may be reloaded with the cord 60 for another wrapping operation.

It should be understood that the examples and embodiments described herein are for illustrative purposes only and that various modifications or changes in light thereof will be suggested to persons skilled in the art and are to be included within the spirit and purview of this application. The invention can take other specific forms without departing from the spirit or essential attributes thereof.

What is claimed is:

1. A hair wrapping device, comprising:

a housing;

a motor contained within said housing;

a cover rotatably mounted to the housing and driven by said motor;

a spool for receiving cord and mounted for rotational movement with said cover;

wherein said cord is held for rotation with said cover;

wherein said cover has an aperture to thread a lock of hair therethrough, whereby rotation of said cover by said motor causes rotation of said cord around the lock of hair, wrapping the hair with said cord.

2. The hair wrapping device according to claim 1, wherein said motor is a reversible motor.

3. The hair wrapping device according to claim 1, wherein said spool rotates independently of said cover due to unwinding of the cord by rotation of the cover.

4. The hair wrapping device according to claim 1, wherein said cover has a sleeve around said aperture, said spool being supported by said sleeve.

5. The hair wrapping device according to claim 1, wherein said cover has a gear provided thereon, said gear being driven by said motor to rotate said cover.

6. The hair wrapping device according to claim 1, wherein said aperture of said cover is located in the center of the cover.

7. The hair wrapping device according to claim 1, wherein said aperture of said cover has an area disposed off-center for receiving the lock of hair; and wherein said aperture narrows towards the center of said cover for securely holding the lock of hair in the center of said cover.

8. The hair wrapping device according to claim 7, wherein said cover includes an opening allowing exit of said cord; and wherein said opening is opposite to said narrowing of said aperture.

9. The hair wrapping device according to claim 7, wherein said aperture is of generally triangular shape.

10. The hair wrapping device according to claim 9, wherein an apex of said triangular shaped aperture is disposed at the center of said cover; and wherein said apex is rounded.

11. The hair wrapping device according to claim 1, further comprising a manually operated mechanism for manually rotating said spool which is operable to rotate said spool in a forwards or reverse direction for adjustment of the cord wrapped around the hair.

12. The hair wrapping device according to claim 1, further comprising a tensioner holding said spool against rotation at a predetermined tension.

13. The hair wrapping device according to claim 12, wherein said tensioner comprises at least one leg having a first and a second end, the leg being pivotally mounted to said cover at said first end, and connected to a spring at said second end, said spring resiliently retaining said leg in a predetermined position, and said spool being held against said leg by said spring.

14. The hair wrapping device according to claim 13, wherein said tensioner comprises at least two legs, the legs each being pivotally mounted to said cover at said first ends, and being joined together by said spring extending between said second ends, said spool being held between said legs.

15. The hair wrapping device according to claim 1, further comprising a threader for threading said lock of hair through said aperture.

16. A method of wrapping hair with cord, the method comprising the steps of:

providing a hair wrapping device having a housing, a motor contained within the housing, a cover rotatably mounted to the housing and driven by the motor, the cover having an aperture therethrough, and a spool mounted to the cover for rotational movement;

wrapping cord around the spool;

holding the cord for rotation with the cover;

threading a lock of hair through the aperture in the cover; and operating the motor to rotate the cover, thereby wrapping the hair with the cord.

17. The method according to claim 16, wherein said step of wrapping the hair takes place on top of the cover, whereby the user can view the wrapping process.

18. The method according to claim 16, wherein the hair wrapping device includes a reversible motor; and wherein said method further comprises the step of at least partially reversing the wrapping by means of the reversible motor.

19. The method according to claim 16, wherein the hair wrapping device includes a manual adjustment mechanism; and wherein the method further comprising the step of manually adjusting the wrapping by means of the manual adjustment mechanism.

20. The method according to claim 16, wherein the spool is held against rotation at a predetermined tension, to impart tension to the cord.

21. The method according to claim 16, wherein the aperture in the cover has an area disposed off-center, and the aperture narrows towards the center of the cover; and wherein said step of threading the lock of hair comprises threading the hair into the off-center area of the aperture, and moving the hair and the into the narrowing of the aperture, whereby the lock of hair can be securely held in the center of the cover.

22. The method according to claim 16, wherein the step of threading the lock of hair through the aperture in the cover includes the use of a threader.

* * * * *